US006321744B1

(12) United States Patent
Dempsey et al.

(10) Patent No.: US 6,321,744 B1
(45) Date of Patent: Nov. 27, 2001

(54) MODULATING FURNACE HAVING A LOW STAGE WITH AN IMPROVED FUEL UTILIZATION EFFICIENCY

(75) Inventors: Daniel Joseph Dempsey, Carmel; Kevin Dale Thompson, Indianapolis, both of IN (US)

(73) Assignee: Carrier Corporation, Farmington, CT (US)

( * ) Notice: Subject to any disclaimer, the term of this patent is extended or adjusted under 35 U.S.C. 154(b) by 0 days.

(21) Appl. No.: 09/629,015

(22) Filed: Jul. 31, 2000

Related U.S. Application Data

(63) Continuation-in-part of application No. 09/407,052, filed on Sep. 27, 1999, now Pat. No. 6,161,535.

(51) Int. Cl.[7] ..... F24H 9/20

(52) U.S. Cl. ..... 126/116 A; 236/11; 236/15 C; 137/613

(58) Field of Search ..... 126/110 R, 116 R, 126/116 A; 137/613, 637, 599.01; 236/11, 15 C

(56) References Cited

U.S. PATENT DOCUMENTS

| | | | | |
|---|---|---|---|---|
| 4,251,025 | | 2/1981 | Bonne et al. . | |
| 4,334,855 | | 6/1982 | Nelson . | |
| 4,340,355 | | 7/1982 | Nelson et al. . | |
| 4,485,965 | * | 12/1984 | McGinnis | 236/11 |
| 4,708,636 | | 11/1987 | Johnson . | |
| 4,729,207 | | 3/1988 | Dempsey et al. . | |
| 5,215,115 | | 6/1993 | Dietiker . | |
| 5,248,083 | | 9/1993 | Adams et al. . | |
| 5,307,990 | | 5/1994 | Adams et al. . | |
| 5,340,028 | | 8/1994 | Thompson . | |
| 5,369,597 | | 11/1994 | Bujak, Jr. . | |
| 5,590,642 | | 1/1997 | Borgeson et al. . | |
| 5,601,071 | * | 2/1997 | Carr et al. | 126/110 R |
| 5,860,411 | * | 1/1999 | Thompson et al. | 126/116 A |

* cited by examiner

*Primary Examiner*—Sara Clarke
(74) *Attorney, Agent, or Firm*—Wall Marjama & Bilinski

(57) ABSTRACT

An improved, induced-draft, gas-fired furnace which is adapted to operate at any of a high, medium and low firing rate. A pressure sensing assembly generates differential pressure signals that vary in accordance with the pressure across a heat exchanger assembly. A gas flow control assembly is responsive to the differential pressure signals, and to signals received from the furnace control circuit, to supply gas to the furnace at any of its three different firing rates, the lowest of those said firing rates corresponding to a gas-air mixture which cannot be ignited. The furnace control circuit applies to the circulating air blower, and to the inducer blower, speed controls signals that are so related to one another that the fuel utilization efficiency of the furnace is at least as great during steady state operation at its low firing rate as during steady state operation at its medium firing rate.

18 Claims, 6 Drawing Sheets

MODULATING FURNACE HAVING A LOW STAGE WITH AN IMPROVED FUEL UTILIZATION EFFICIENCY

Cross-References To Related Applications

This is a continuation-in-part of U.S. patent application Ser. No. 09/407,052, filed Sep. 27, 1999, now U.S. Pat. No. 6,161,535.

BACKGROUND OF THE INVENTION

The present invention relates to induced-draft, gas-fired furnaces, and is directed more particularly to an improved induced-draft, gas-fired furnace which is adapted to operate at any of three different firing rates.

An important consideration in the design of multi-stage furnaces, i.e., furnaces which have more than one firing rate, is the quantity of air per unit time which they circulate through the space to be heated at each of those different firing rates. This quantity of air, commonly referred to as the circulating airflow of the furnace, is preferably as low as the heating requirements of the space to be heated permits. This is because lower speeds are associated with quieter operation. Circulating airflows which are relatively lower, but which continue for relatively longer periods of time, are also desirable because they provide greater thermal comfort.

Quietness of operation and thermal comfort, however, are only two of many things that must be considered in designing multi-stage furnaces. Other considerations include the annual fuel utilization efficiency or AFUE of the furnace, the furnace operating cost, and flue gas emission requirements. Still another consideration is the requirement that the heat exchanger of the furnace be protected from "cold spot corrosion" either by maintaining it at a temperature too high for water to condense thereon, or by making it from a corrosion resistant material. Because these requirements conflict with one another, tradeoffs must be made.

Examples of furnace designs which make various kinds of tradeoffs are described in U.S. Pat. No. 4,708,636 (Johnson), U.S. Pat. No. 5,248,083 (Adams et al), U.S. Pat. No. 5,307,990 (Adams et al), and U.S. Pat. No. 5,590,642 (Borgeson et al). The Johnson patent describes a furnace which includes a modulating gas valve and furnace controls that are responsive to a flow sensor that is mounted in the stack. This patent is concerned primarily with maintaining the proper fuel-to-air ratio and a predetermined minimum airflow in the stack, however, and does not take into account the importance of multiple stages and their effect on thermal comfort and noise levels.

The Adams et al 083 patent describes a furnace in which a modulating gas valve is used to control the firing rate of the burner in accordance with the temperature of the heat exchanger, and in which the blower speed is changed as necessary to match the delivery of heat to the heat load on the furnace. The furnace described in this patent, however, uses an adaptive control algorithm which tries to maintain constant on/off times by regulating the blower speed based on previous on/off cycle data for prior heating cycles and is not coordinated with the speed of the induced draft blower. As a result, the efficiency, operating cost, and noise level of the furnace are not optimized.

The Adams et al 990 patent also describes a furnace in which a modulating gas valve is used to control the firing rate of the burner in accordance with the temperature of the heat exchanger. In this furnace, however, the blower speed is continuously adjusted as necessary to maintain a constant differential pressure across the heat exchanger, but is still not coordinated with the speed of the induced draft blower. As in the case of the Adams et al 083 patent, the efficiency, operating cost, and noise level of the furnace again are not optimized.

The Borgeson et al patent describes a furnace in which the state of a modulating gas valve and a variable speed induced draft blower are both varied as necessary to maintain the temperature of a heat exchange medium at a constant value while the blower speed is varied to maintain a constant circulating air temperature. In this case temperature sensors are used and these tend to react in a very unpredictable manner from one installation to the next because they are location and airflow sensitive and do not account for all possible variations.

In an earlier filed U.S. patent application Ser. No. 09/407,052, filed Sep. 27, 1999, now U.S. Pat. No. 6,161,535, which is commonly assigned herewith, and which is hereby expressly incorporated by reference herein, there is described a method and apparatus for increasing the low stage circulating airflow of a furnace without creating conditions that give rise to cold spot corrosion. Generally speaking, this method involves the maintaining of a predetermined relationship between the low stage circulating airflow of the furnace and the low stage combustion airflow thereof, i.e., the rate at which the induced draft blower supplies combustion air to the burner. By maintaining a predetermined relationship between the magnitudes of the combustion and circulating airflows, the temperature at the outlet of the heat exchanger is kept substantially constant at a value high enough to prevent water from condensing thereon and causing cold spot corrosion.

SUMMARY OF THE INVENTION

With the present invention, the use of the airflow relationships described in our earlier application is expanded and applied to a furnace which was originally designed as a two-stage furnace, but which been modified to operate at a new, third and lower firing rate. As modified, the new furnace not only operates at reduced noise levels and provides increased thermal comfort, it also has a reduced electrical operating cost. Advantageously, these improved results are achieved without giving rise to unacceptable excess air levels, and without allowing cold spot corrosion to occur in the heat exchanger.

In preferred embodiments of the invention, these results are achieved by maintaining, between the magnitudes of the combustion (or circulating) airflows that are established at the low and medium firing rates of the furnace, and between the magnitudes of the combustion and circulating airflows that are established at the low and medium firing rates of the furnace, relationships which assure the maintenance of acceptable excess air levels, and the maintenance of either an undiminished total operating cost or a reduced electrical operating cost. Depending on the embodiment, cold spot corrosion is prevented by either maintaining a heat exchanger wall temperature that is high enough to prevent water from condensing thereon, or by fabricating the heat exchanger from a corrosion resistant material, such as stainless steel.

The furnace of the invention includes a gas flow control assembly which, in all preferred embodiments, includes a main gas valve that has a closed state and two open states and a throttling valve that has two open states. These valves are connected in series between the gas supply and the burner, thereby assuring that the overall rate at which gas is supplied to the burner is dependent on the states of both valves. Because these valves are separate but connected in series, they may be actuated in predetermined combinations of states, with different combinations of states corresponding to different respective ones of the three desired firing rates of the furnace, or to a medium stage ignition state that initially allows the establishment of a gas flow rate high enough to permit ignition to occur, and then reduces the gas flow rate for steady state operation at low stage. The use of a relatively low gas flow rate during steady state low stage operation, in combination with other features of the present invention, allows the furnace to have a low operating cost, while providing reduced noise levels and increased thermal comfort.

The furnace of the invention may also, however, use a gas flow control assembly which includes either a single modulating or three stage gas valve, i.e., a valve specifically designed to provide three different firing rates, or three independent valves connected in parallel. Because furnaces which use gas flow control assemblies of the latter types can be made to operate in generally the same way as the gas flow assembly of the preferred embodiment, they will be understood to be within the contemplation of the present invention. Because such gas flow control assemblies are presently more expensive than the gas flow assembly of the preferred embodiment, however, furnaces which include them are not preferred embodiments of the present invention.

The furnace of the invention also preferably, but not necessarily, includes a pressure sensing assembly which includes one or more pressure sensing switches which are connected to sense a pressure approximately equal to the differential pressure across the heat exchanger assembly and generate one or more differential pressure signals that correspond thereto. Together with call-for-heat signals indicative of the heating requirements of the space to be heated, these differential pressure signals are used by the furnace control circuitry of the invention to establish and maintain high, medium and low stage operation in the furnace. In all preferred embodiments, the furnace control circuitry is arranged so that the furnace spends as much time possible operating at its lowest firing rate and lowest circulating airflow value. By causing the furnace to operate in this way, the furnace control circuit assures not only that the furnace operates at reduced noise and increased thermal comfort levels, but are also at a reduced electrical power cost. This is possible because, while the use of lower circulating airflows and lower firing rates result in longer operating hours, the cost of the electrical power used during these longer operating hours declines more rapidly than the operating hours increase.

In accordance with the present invention, the furnace control circuitry is arranged to apply to the blower and inducer motors speed control signals that cause the latter to establish circulating and combustion airflows which are so related to one another that the furnace is able to operate with high efficiency, and to provide reduced noise levels and increased thermal comfort, while maintaining acceptable excess air and flue gas levels. In a first embodiment, these conditions are met by applying to the inducer and blower motors speed control signals which assure that the combustion airflows which the furnace establishes during low and medium stage operation are so related to one another, and to the circulating airflows which the furnace establishes during low, medium and high stage operation, that the furnace not only operates at acceptable excess air and flue gas levels, but also operates at reduced noise and improved and thermal comfort levels. The first embodiment of the invention is also able to maintain the walls of the heat exchanger assembly at a temperature high enough to prevent cold spot corrosion in the non-condensing areas of the furnace. As a result, a condensing furnace constructed in accordance with this embodiment may use a heat exchanger assembly which includes a primary (or non-condensing) heat exchanger unit which is either not composed of a corrosion resistant material, such as stainless steel, or which is composed of a material which has a limited corrosion resistance.

In a second embodiment, these conditions are met by applying to the inducer and blower motors speed control signals which assure that the circulating airflows which the furnace establishes during low and medium stage operation are so related to one another, and to the combustion airflows which the furnace establishes during low, medium and high stage operation, that the furnace not only operates at acceptable excess air and flue gas levels, but also operates at a further reduced noise and thermal comfort levels. A furnace constructed in accordance with the second embodiment of the invention also has a total low stage operating cost (fuel cost plus electrical power cost) which is lower than its two-stage counterpart. Because the achievement of these results may cause the furnace to be unable to maintain a low stage heat exchanger temperature that is high enough to prevent cold spot corrosion, embodiments of this type require the use of a heat exchanger assembly that is composed entirely of a corrosion resistant material, such as stainless steel.

Other objects and advantages of the present invention will be apparent from the following description and drawings, in which:

DESCRIPTION OF THE PREFERRED EMBODIMENTS

Because three-stage furnaces constructed in accordance with the present invention comprise improvements over the most nearly similar two-stage furnaces of the prior art, the furnaces of the present invention are most easily understood in terms of the differences between them and the most nearly similar two-stage furnaces of the prior art. Accordingly, the following description will first discuss the structure and operation of two-stage furnaces which are known in the art, and then discuss how the structure and operation of three-stage furnaces which are constructed in accordance with the present invention differ from those two-stage furnaces.

Prior Art Two-Stage Furnaces

Figure 1:
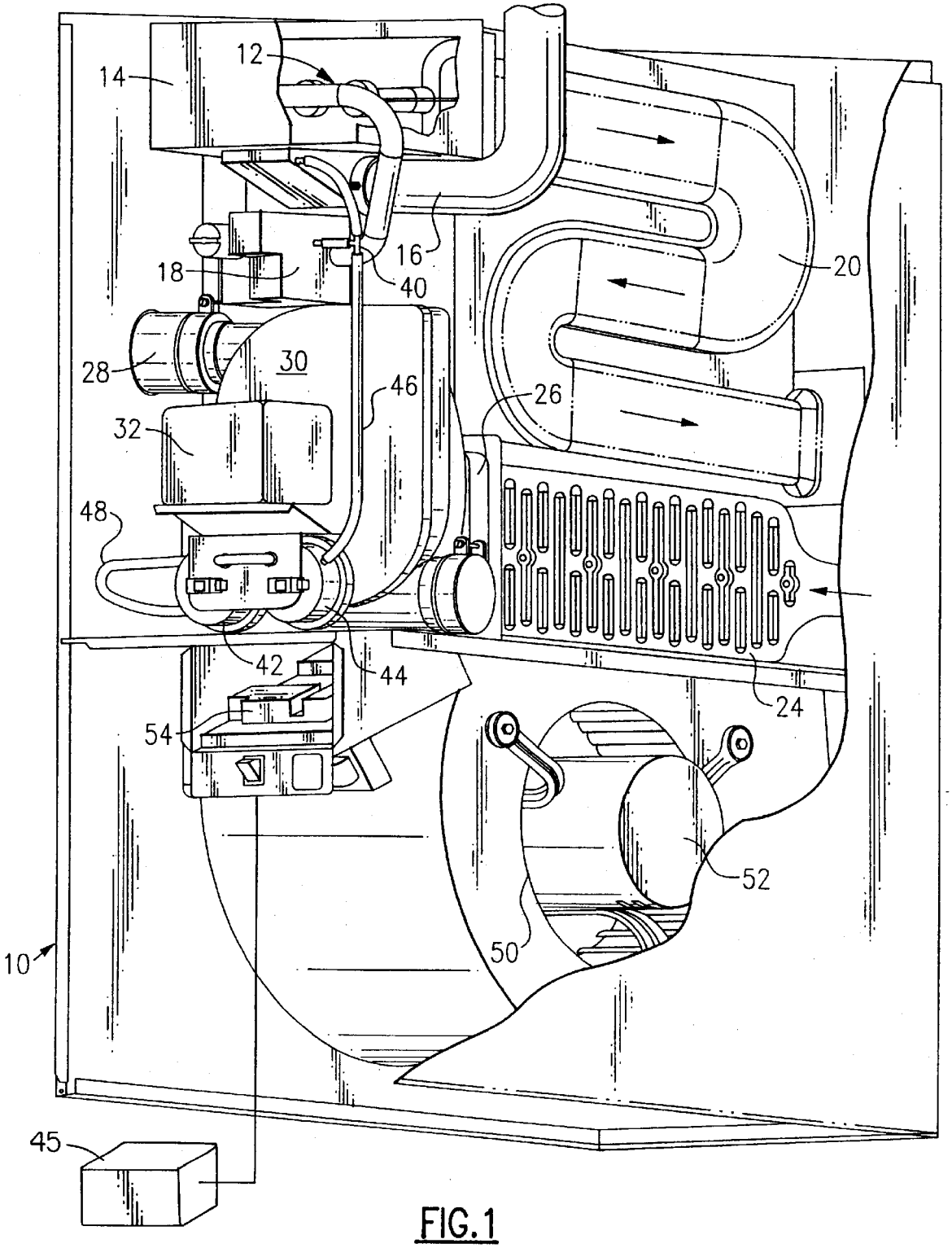
FIG.1 Prior Art
FIG. 1 is an oblique, cutaway view of a two-stage furnace which is of a type known in the prior art.

Referring to FIG. 1, there is shown an oblique cutaway view of a two-stage condensing furnace 10 of a type known in the prior art. Furnace 10 may, for example comprise a model 58MVP gas-fired furnace manufactured by Carrier Corp. Furnace 10 includes a burner assembly 12 that is located within a burner box 14 and is supplied with air via an air supply duct 16. The gases produced by combustion within burner box 14 flow through a heat exchanger assembly 20-24 which includes a primary or non-condensing heat exchanger 20, a secondary or condensing heat exchanger 24, and a condensate collector box 26, before being vented to the atmosphere through an exhaust vent 28. The flow of these gases, herein called combustion air, is maintained by an induced draft blower 30 which is driven by an inducer motor 32 in response to speed control signals that are generated by or under the control of a furnace control circuit located within furnace control 54, in response to the states of a low pressure switch 42, a high pressure switch 44, and call-for-heat signals received from a thermostat 45 in the space to be heated. Fuel gas is supplied to burner assembly 12 through a gas valve 18, and is ignited by an igniter assembly (not shown). Valve 18 may comprise a conventional, solenoid operated two-stage gas valve which has a closed state, a high open state associated with the operation of furnace 10 at its high firing rate, and a low open state associated with the operation of furnace 10 at its low firing rate.

Air from the space to be heated is drawn into furnace 10 by a blower 50 which is driven by a suitable blower motor 52 in response to speed control signals that are generated by or under the control of a furnace control circuit located within furnace control 54. The discharge air from the blower 50, herein called circulating air, passes over condensing heat exchanger 24 and primary heat exchanger 20, in counterflow relationship to the flow of combustion air, before being directed to the space to be heated through a duct system (not shown). While the present invention is preferably used with condensing furnaces, i.e., furnaces which use heat exchanger assemblies that include primary and secondary heat exchangers, it is not limited to use with such furnaces. It will therefore be understood that the present invention may also be used with non-condensing furnaces, i.e., furnaces which have heat exchanger assemblies that include only a single heat exchanger unit.

Because furnace 10 is a two-stage furnace, inducer motor 32 and blower motor 52 must each be able to operate at a low speed when the furnace is operating at its low firing rate (low stage operation) and at a high speed when the furnace is operating at its high firing rate (high stage operation). In furnace 10, motors 32 and 52 are preferably motors that are designed to operate at a continuously variable speed, and are made to operate at their low and high speeds in response to speed control signals generated by furnace control 54. Motors 32 and 52 may each, for example, comprise Electronically Commutated Motors (ECMs) of the type discussed in U.S. Pat. No. 4,729,207 (Dempsey et al), which is hereby expressly incorporated herein by reference. As explained in this patent, the furnace controls which are used with these types of motors preferably not only control the steady state low and high operating speeds thereof, but also the times and the rates or torques at which they accelerate to and decelerate from these operating speeds.

As is well known to those skilled in the art, the combustion efficiency of an induced-draft gas-fired furnace is optimized by maintaining the proper ratio of the gas input rate and the combustion airflow rate. Generally, the ideal ratio is offset somewhat for safety purposes by providing for slightly more combustion air (i.e., excess air) than that required for optimum combustion efficiency. In the furnace of FIG. 1, the excess air level is kept within acceptable limits in part by low and high pressure switches 42 and 44, respectively, which cause inducer motor 32 to run at speeds that are related to the differential pressure across the heat exchanger system thereof. To the end that this may be accomplished, low and high pressure switches 42 and 44 are connected to burner box 14, through a pressure tube 46, to sense a pressure that approximates that at the inlet of primary heat exchanger 20, and are connected to collector box 26, through a pressure tube 48, to sense a pressure that approximates that at the outlet of secondary heat exchanger 24. Because pressure switches 42 and 44 are of commercially available types, and operate in the manner described in the above-cited Dempsey et al patent, neither the structure nor the operation thereof will be discussed in detail herein.

Figure 2:
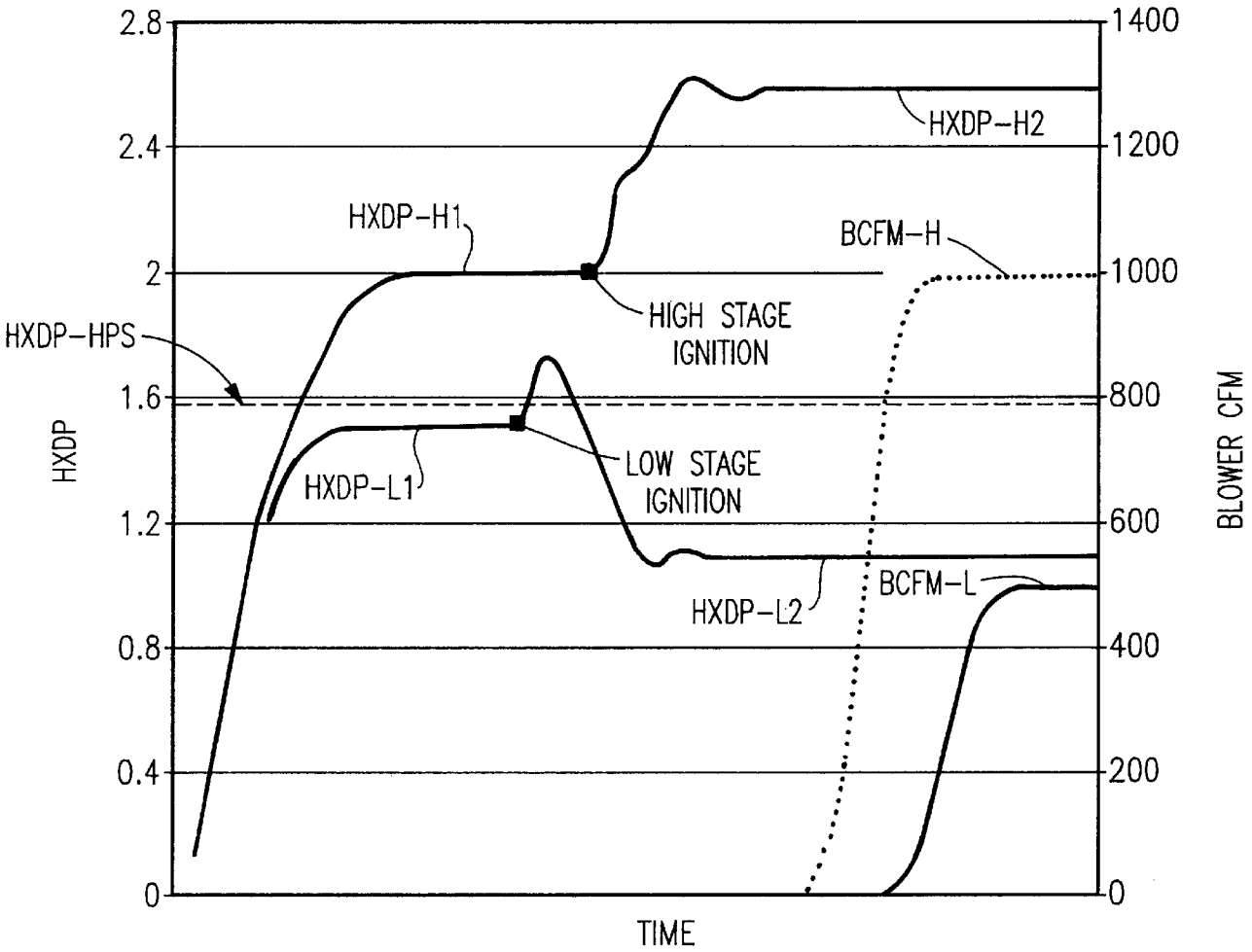
FIG.2 Prior Art
FIG. 2 is a diagram which shows how the heat exchanger differential pressure and the circulating airflow of the prior art furnace of FIG. 1 vary as functions of time during high and low stage operation.

Referring to FIG. 2, there is shown a diagram which illustrates the operation of the two-stage prior art furnace of FIG. 1. The diagram of FIG. 2 includes a first vertical axis, labeled HXDP, which shows, for both low and high stage furnace operation, the differential pressure which the flow of combustion air creates across heat exchanger system 20-24, and a horizontal time axis which shows the time elapsed since the last call-for-heat signal was generated. The diagram of FIG. 2 also includes a second vertical axis, labeled BLOWER CFM, which shows the magnitude of the circulating airflow established by blower 50 plotted against the same horizontal time axis.

The operation of the prior art furnace shown in FIG. 2 may be summarized as follows. When there occurs a call-for-heat signal which indicates that the furnace is to operate at its low firing rate, the furnace control controllably accelerates inducer motor 32 until it attains a pre-ignition steady state speed that corresponds to a heat exchanger differential pressure, HXDP-L1, that is sufficient to actuate low pressure switch 42, but not high pressure switch 44. When this differential pressure has existed for a preset time, valve 18 assumes its low open state. Under this condition, valve 18 supplies gas at the low firing rate to burner 12 where it ignites and begins heating the combustion air passing through heat exchange assembly 20-24. This heating initiates a change in the density of the combustion air which, in turn, causes an increase in the differential pressure across heat exchange assembly 20-24. The inducer motor speed is then reduced until it attains a steady state speed value that corresponds to a heat exchanger differential pressure, HXDP-L2, that is somewhat lower than its pre-ignition value. Soon after this occurs, the furnace control causes blower motor 52 to accelerate until it reaches a steady state speed that corresponds to the circulating airflow value, BCFM-L, at which furnace 10 is designed to operate at low stage. Similarly, when there occurs a call-for-heat signal which indicates that the furnace is to operate at its high firing rate, the furnace control accelerates inducer motor 32 until it attains a pre-ignition steady state speed that corresponds to a heat exchanger differential pressure, HXDP-H1, that is sufficient to actuate high pressure switch 44. When this differential pressure has existed for a preset time, valve 18 assumes its high open state. Under this condition, valve 18 supplies gas at the high firing rate to burner 12 where it ignites and begins heating the combustion air passing through heat exchanger system 20-24. This heating initiates a change in the density of the combustion air which, in turn, causes an increase in the differential pressure across heat exchange system 20-24. The inducer motor speed is then increased to attain a steady state speed value that corresponds to a heat exchanger differential pressure, HXDP-H2, that is somewhat higher than its pre-ignition value. Soon after this occurs, the furnace control causes blower motor 52 to accelerate to a steady state speed value that corresponds to the circulating airflow value, BCFM-H, at which furnace 10 is designed to operate.

Since the above-mentioned speeds and differential pressure values, and the manner in which they are determined and established, are discussed in the earlier cited Dempsey et al patent, these speeds and differential pressure values will be discussed herein only to the extent necessary to clarify the nature of the present invention, and how the present invention differs from the invention described in that patent.

Figure 3:
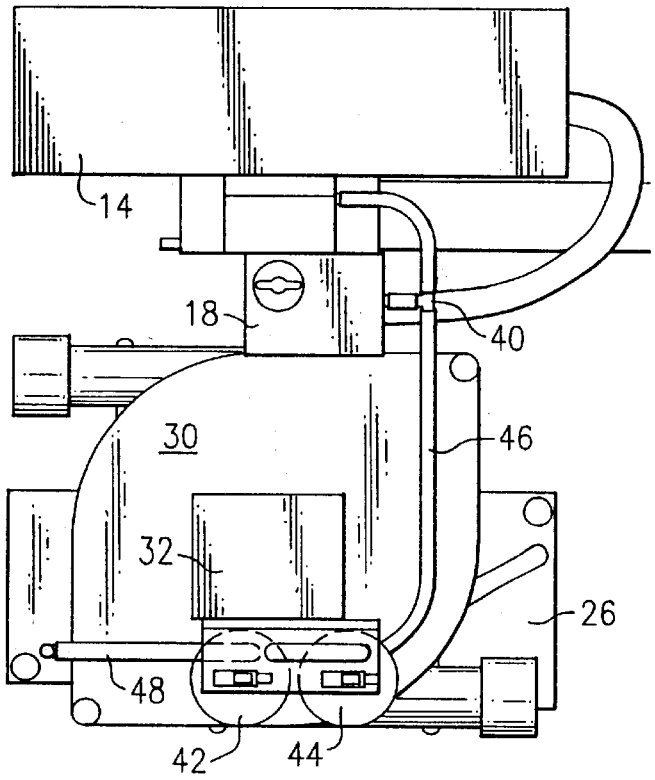
FIG.3 Prior Art
FIG. 3 comprises a simplified view of the gas flow control assembly used in the prior art furnace of FIG. 1.

Referring to FIG. 3 there is shown a simplified view of the gas flow control portion of the prior art furnace of FIG. 1, corresponding parts being identified by the same numbers in both Figures. In the simplified view of FIG. 3, there is shown only gas valve 18 and those parts of the furnace which are fluidically connected to it, all other elements, including furnace control 54 and the electrical wiring which connects that furnace control 54 to valve 18 and pressure switches 42 and 44, being omitted or cutaway for the sake of clarity.

Embodiment 1

Because the mechanical aspects of the differences between a three-stage furnace constructed in accordance with a first preferred embodiment of the invention and the above-described prior art two-stage furnace are confined largely to the gas flow control assemblies thereof, the mechanical aspects of the first embodiment of the invention will be described with reference to FIG. 4, which comprises a simplified view of the type included in FIG. 3.

Figure 4:
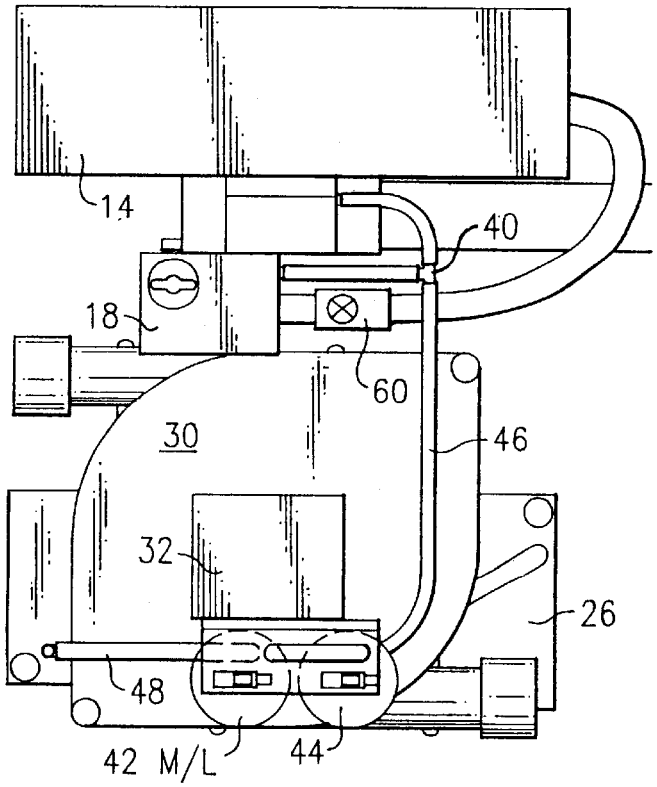
FIG. 4 is a simplified view of a gas flow control assembly which may be used in a first embodiment of a three-stage furnace constructed in accordance with the present invention.

Referring to FIG. 4 there is shown the preferred embodiment of a gas flow control assembly that is suitable for use in the first embodiment of the invention. This assembly is generally similar to that shown in the prior art gas flow control assembly of FIG. 3, corresponding parts being similarly numbered, except for two important differences. A first of these differences is that the gas flow control assembly of FIG. 4 includes a throttling valve 60 which is disposed in fluidic series between main gas valve 18 and burner box 14, and which enables the furnace control circuit to controllably establish the third low stage firing rate contemplated by the invention, a firing rate which is preferably approximately 40% the high stage firing rate, but which may be as low as 30% or as high as 50% thereof.

A second of these differences is that the gas flow control assembly of FIG. 4 includes a pressure switch 42M/L which is used in establishing and maintaining both medium and low stage operation in the three-stage furnace of the invention, rather than just the low stage operation thereof, as in the two-stage prior art furnace discussed in connection with FIG. 3. As will be explained more fully later, it is possible to use a single pressure switch for both medium and low stage operation because, in the preferred embodiment, the magnitudes of the combustion airflows which are established by the inducer blower during the operation of the furnace at its medium and low firing rates are preferably so related to one another that they establish the same differential pressure across the heat exchanger.

Throttling valve 60 preferably comprises a two-stage throttling valve of a type which will be discussed later in connection with FIG. 8. Throttling valve 60 has a first, high open state in which it presents a first, relatively low resistance to the flow of gas therethrough, and a second, low open state in which it presents a second, relatively high resistance to the flow of gas therethrough. When the furnace is to operate at its high or medium firing rates, valve 60 will be in its first, high open state. Under this condition, the rate of gas flow to burner 12 will be at either 100% or 65% of the high stage flow rate, depending on whether furnace control circuit 40 causes main gas valve 18 to be in its high or low open state.

When the furnace is to operate at its third, low stage firing rate, furnace control circuit 40 causes main gas valve 18 to be in its low open state while initially allowing throttling valve 60 to remain in its high open state. Under this condition, the gas flow rate will be at 65% of its high stage flow rate, a rate at which the gas-air mixture is easily ignited. This condition will hereinafter be referred to as the medium stage ignition state of the gas flow control assembly. Once ignition has occurred, furnace control circuit 40 causes throttling valve 60 to assume its low open state. Under this condition, the gas flow rate will drop to 40% of its high stage flow rate, a rate at which the gas-air mixture cannot be ignited, but which will support combustion after ignition has occurred. It will therefore be seen that, by establishing suitable combinations of states in valves 18 and 60, the furnace control circuit is able to cause the furnace to operate at any of the three steady state firing rates contemplated by the present invention, and to establish a medium stage ignition state that allows the gas-air mixture to be ignited at a first relatively high gas flow rate, and then burned at a second relatively low gas flow rate.

Figure 8:
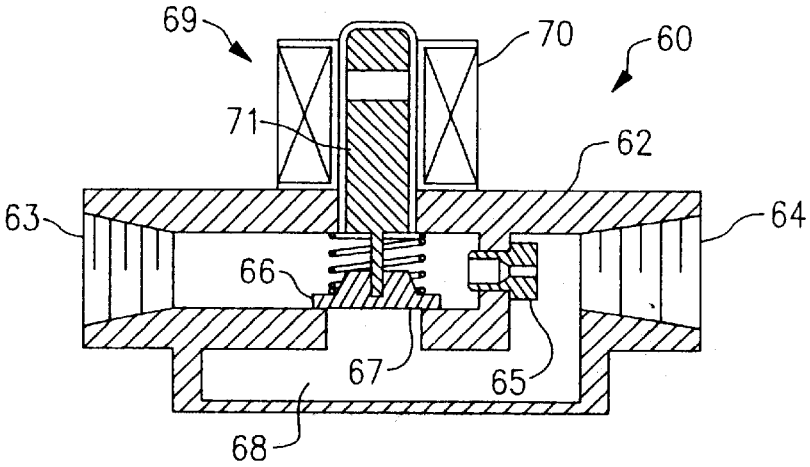
FIG. 8 is a cutaway view of one kind of throttling valve which may be used in gas flow control assemblies of types contemplated by the present invention.

Referring to FIG. 8, there is shown a cutaway view of one exemplary type of valve which may be used as throttling valve 60 of the gas flow control assembly of FIG. 4. In the embodiment of FIG. 8, throttling valve 60 includes a housing 62 which defines two alternatively selectable gas flow paths between an inlet 63 and an outlet 64. One of these paths extends from inlet 63 to outlet 64 though a suitable restrictor element 65, and is selected when a valve member 66 is seated against a valve seat 67. When this path is selected, valve 60 is in its low open state and presents a relatively high resistance to the flow of gas therethrough. The other path extends from inlet 63 to outlet 64 through a chamber 68 that bypasses flow restrictor 65, and is selected when valve member 66 is not seated against valve seat 67. When this path is selected, valve 60 is in its high open state and presents a relatively low resistance to the flow of gas therethrough. The path that is selected is controlled by furnace control 54 via a suitable solenoid 69 that includes an electrically actuated coil 70 and an armature 71 that is coupled to valve member 66. Because throttling valves of the subject type are well known in the art, the construction and use thereof will not be described in detail herein.

While the furnace of the invention preferably uses a gas flow control assembly, of the type shown and described in connection with FIG. 4, it is not limited to use with a gas flow control assembly of the latter type. The furnace of the invention may, for example, use a gas flow control assembly which includes either a single modulating or three stage gas valve, i.e., a valve which is specifically designed to controllably establish three different firing rates, or three independent valves connected in parallel, provided that these valves are controlled so that they establish combinations of states that are generally similar to those described in connection with FIG. 4. Because the use of three stage valves and parallel connected valves are well known to those skilled in the art, gas flow control assemblies which use such valves will not be shown or described in detail herein.

Figure 5:
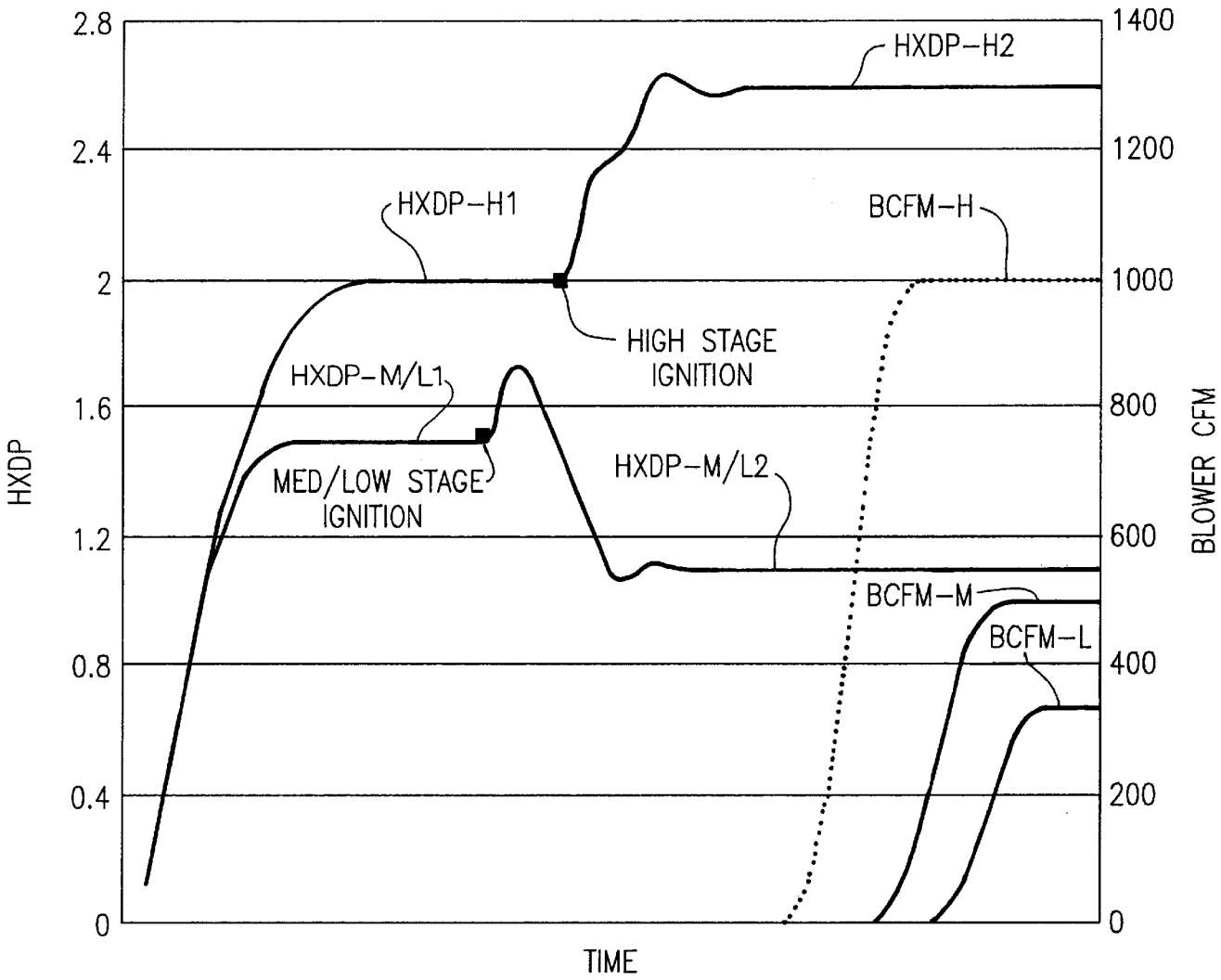
FIG. 5 is a diagram which shows how the heat exchanger differential pressure and the circulating airflow of a first embodiment of the three-stage furnace of the invention vary as functions of time during high, medium and low stage operation.

The operation of the first embodiment of the furnace of the invention will now be described with reference to FIG. 5. FIG. 5 includes a first vertical axis which shows the differential pressure across the heat exchanger system (HXDP) of a furnace having a gas flow control assembly of the type shown in FIG. 4. Because the magnitude of the HXDP is related to the magnitude of the combustion airflow which is, in turn, related to the speed of the inducer motor, the vertical axis of FIG. 5 may also be regarded as showing the speed of the inducer motor in RPM. FIG. 5 also includes a horizontal axis which shows the time elapsed since the last call-for-heat signal was received from the space to be heated. Finally, FIG. 5 includes a second vertical axis, labeled BLOWER CFM, which shows the magnitude of the circulating airflow of the furnace plotted against the same horizontal time axis.

Referring to FIG. 5, the operation of the first embodiment of the furnace of the invention may be summarized as follows. When the furnace control circuit receives a low stage call-for-heat signal, it controllably accelerates inducer motor 32 until it attains a preignition steady state speed that corresponds to a heat exchanger differential pressure, HXDP-M/L1, that is sufficient to actuate medium-low pressure switch 42M/L, but not high pressure switch 44. When this differential pressure has existed for a preset time, valve 18 assumes its low open state while valve 60 is in its high open state. Under this condition, valve 18 and valve 60 causes gas to be supplied to the burner 12 at the medium firing rate. There the gas ignites and begins heating the combustion air passing through heat exchange system 20-24. This, in turn, initiates a change in the density of the combustion air and a transient increase in the differential pressure across heat exchange system 20-24.

Since the furnace control circuit is responding to a low stage call-for-heat signal, it then causes valve 60 to assume its low open state, and thereby reduces the gas flow rate to a value that corresponds to low stage operation, namely: 40% of the value used for high stage operation. The furnace control then reduces the speed of the inducer motor until it establishes the steady state combustion airflow that is associated with low and medium stage operation, a value that corresponds to heat exchanger differential pressure HXDP-M/L2. The magnitude of this low stage combustion airflow is selected, relative to the magnitude of the medium stage gas flow rate that will also allow the furnace to operate at acceptable excess air and CO levels for low stage operation.

Soon after the inducer motor reaches its steady state low stage speed, the furnace control causes blower motor 52 to accelerate until it reaches a steady state speed that corresponds to the circulating airflow, BCFM-L, at which furnace 10 is designed to operate at low stage. The magnitude of the circulating airflow is selected, relative to the magnitude of the combustion airflow, so that the furnace meets its thermal rise requirements while keeping the lowest wall temperature of the primary heat exchanger 20 high enough to prevent cold spot corrosion. The magnitude of the circulating airflow is generally much lower than that used during medium stage operation and is consistent with providing a higher thermal rise than that used during medium stage operation, thereby providing a higher level of thermal comfort, while assuring reduced electrical consumption and a relatively low circulating air blower noise level.

When the furnace control circuit receives a medium stage call-for-heat signal, it accelerates inducer motor 32 and ignites the flow of gas in generally the same way as during low stage operation, but causes valve 60 to remain in its high open state. Under this condition, gas will be supplied to the burner at a rate that is 65% of the firing rate used during high stage operation. The furnace control then reduces the speed of the inducer motor until it establishes the steady state combustion airflow that is associated with medium stage operation. For reasons which will be explained more fully later, the combustion airflow that is established during medium stage operation preferably gives rise to the same heat exchanger differential pressure, HXDP-M/L2, as the combustion airflow that is established during low stage operation. The sameness of the low and medium stage differential pressures allows pressure switch 42M/L to be used during both low and medium stage operation, thereby eliminating the need to provide a pressure switch for each of the three stages of furnace operation. It will be understood, however, that this sameness is not an essential feature of the invention, and that low and medium stage differential pressures may be designed to vary enough to require a third pressure switch.

Soon after the inducer motor reaches its steady state speed, the furnace control causes blower motor 52 to accelerate until it reaches a steady state speed that corresponds to the circulating airflow value, BCFM-M, at which furnace 10 is designed to operate at medium stage. This circulating airflow has a magnitude which is higher than that used during low stage operation and reflects the higher firing rate which is used during medium stage operation.

As will be apparent to those skilled in the art, the fact that the first embodiment of the furnace of the invention establishes the same HXDP during medium and low stage operation does not mean that inducer blower motor 32 runs at the same speed during medium and low stage operation. This is because the furnace operates at a lower firing rate during low stage operation than during medium stage operation, and thereby causes the combustion air to have a higher density during low stage operation than during medium stage operation. As a result, even though the embodiment of FIG. 5 establishes the same HXDP value during medium and low stage operation, the furnace control 54 will be understood that it could generate the same or two different inducer motor speed control signals for medium and low stage operation. If the same inducer motor speed control signal is generated for medium and low stage operation a slightly lower HXDP will result during low stage operation that could produce nuisance opening of pressure switch 42M/L. This can be compensated for by designing for low stage HXDP and accepting a slightly higher HXDP for medium stage or two different inducer motor speed control signals for medium and low stage operation can be used such that the inducer motor speed for low stage operation will be slightly higher then the inducer motor speed for medium stage operation.

In accordance with one feature of the present invention, the magnitudes of the combustion and circulating airflows that are established during low and medium stage operation are so related to one another that all parts of the wall of primary heat exchanger 20 remain at temperatures that are above the condensation temperature of water during both low and medium stage operation. As a result, the primary heat exchanger of the first embodiment of the invention is not subject to cold spot corrosion and may, therefore, be made of steel which is not corrosion resistant, or which has only a limited corrosion resistance. If the furnace is a non-condensing furnace, i.e., a furnace that uses a heat exchanger assembly that does not include primary and secondary heat exchanger units, then the magnitudes of the combustion and circulating airflows that are established during low and medium stage operation must be so related to one another that all parts of the heat exchanger assembly remain at temperatures that are above the condensation temperature of water during both low and medium stage operation.

When the furnace control circuit receives a high stage call-for-heat signal, it accelerates inducer motor 32 and ignites the flow of gas in generally the same way as during low and medium stage operation (except that it is responsive to pressure switch 44 as well as pressure switch 42M/L), and which causes both main gas valve 18 and throttling valve 60 to be in their high open states. Under this condition, gas will be supplied to the burner at the high stage firing rate of the furnace. The furnace control then increases the speed of the inducer motor from a speed which corresponds to its pre-ignition HXDP value of HXDP-H1 to its post-ignition HXDP value of HXDP-H2 and thereby establishes the combustion airflow that is associated with the steady state operation of the furnace at high stage.

Soon after the combustion airflow reaches its steady state value, the furnace control 54 causes blower motor 52 to accelerate until it reaches a steady state speed that corresponds to the circulating airflow value, BCFM-H, at which furnace 10 is designed to operate at high stage. This circulating airflow has a magnitude which is higher than that used during low and medium stage operation and reflects the higher firing rate which is used during high stage operation.

In view of the foregoing, it will be seen that a furnace constructed in accordance with the first embodiment of the invention has a number of important advantages over a prior art furnace which has a similar overall heating capacity, but which can only operate at firing rates which correspond to the high and medium firing rates thereof. One of these is that, since the furnace of the invention will ordinarily spend most of its time operating at low stage, it will operate at a lower average noise level and provide a higher average thermal comfort level. Another is that, since the amount of electrical power used during low stage operation declines faster than operating hours increase, the furnace of the invention will operate at a reduced electrical operating cost. In addition, since the furnace of the invention uses the same or at least roughly the same HXDP during medium and low stage operation, it provides these advantages without reducing the lowest wall temperature of the primary heat exchanger 20 to the point at which cold spot corrosion will occur, thereby making it unnecessary to construct the heat exchanger of a corrosion resistant material, such as stainless steel. As a result, a furnace constructed in accordance with the first embodiment of the invention may use a heat exchanger which is the same as or similar to those used in two-stage prior art furnaces of similar overall heating capacity.

While the first embodiment of the invention has been described with reference to a gas flow control assembly which includes a limited number of distinct states, the practice of this embodiment is not limited to the use of gas flow control assemblies of this type. The first embodiment may, for example, be practiced using a gas flow control assembly which includes a single stage main gas valve and a pressure actuated throttling valve that is adapted to provide a continuously variable gas flow rate which is responsive to the differential pressure across the heat exchanger system. In embodiments of this type, only one pressure switch is used, and furnace control 54 determines the inducer motor RPM values which yield the HXDP values that are necessary to cause the throttling valve to establish the gas flow rates that are used during high, medium and low stage operation of the furnace. Because the structure and operation of pressure actuated throttling valves are well known to those skilled in the art, a gas flow control assembly which uses such a valve will not be shown or described in detail herein.

Embodiment 2

In spite of the many advantages provided by the first embodiment of the invention, it makes certain necessary tradeoffs in the interest of increasing the number of desirable operating characteristics which it is able to provide simultaneously. One of these is that, in spite of its having a lower electrical operating cost which is less than that of an otherwise similar two-stage furnace, a furnace constructed in accordance with the first embodiment has an total operating cost which is slightly higher than a two-stage furnace of similar overall heating capacity. This is because, in keeping the lowest wall temperature of primary heat exchanger 20 high enough to prevent cold spot corrosion, the first embodiment does not optimize the combustion airflow for low stage operation and causes the furnace to operate at lower than optimum annual fuel utilization efficiency or AFUE which results in higher fuel cost which more than offsets the savings from lowering the electrical operating cost.

To the end that the present invention may be practiced in a way which affords the above-described advantages over two-stage furnaces of similar overall heating capacity, but which does not result in the above-described slight increase in total operating cost, there is provided a second embodiment of the invention. As will be described more fully later, this second embodiment of the invention makes tradeoffs that are different from those made by the first embodiment, and has a total operating cost which is lower than a two-stage furnace of similar overall heating capacity and construction, but which has a higher cost of manufacture. Unlike the first embodiment of the invention, which operates by establishing the same HXDP during low and medium stage operation and maintaining the lowest wall temperature of primary heat exchanger 20 high enough to prevent cold spot corrosion, the second embodiment of the invention operates by establishing the same circulating airflow during low and medium stage operation and preventing cold spot corrosion by using a heat exchanger which is made of a corrosion resistant material such as stainless steel.

Figure 6:
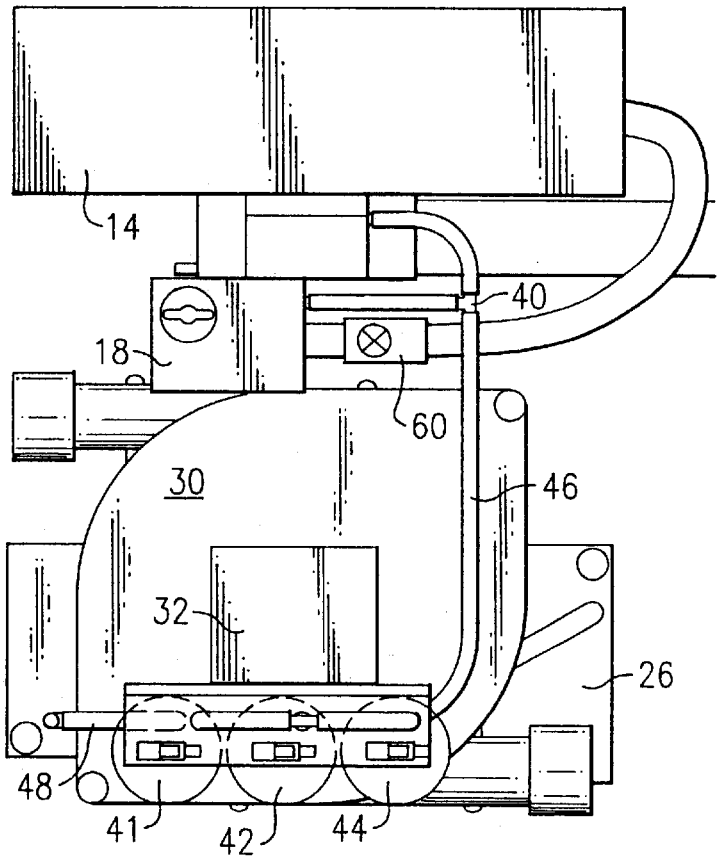
FIG. 6 is a simplified view of a gas flow control assembly which may be used in a second embodiment of a three-stage furnace constructed in accordance with the present invention.

Referring to FIG. 6, there is shown one example of a gas flow control assembly which is suitable for use in the second embodiment of the furnace of the invention. The gas flow control assembly of FIG. 6 is generally similar to that of FIG. 4, like functioning parts being similarly numbered, except in one important respect. This is that it includes not only high and medium stage pressure switches 44 and 42, but also a low stage pressure switch 41. All three of these pressure switches are connected to sense the differential pressure across the heat exchanger assembly, and are used by the furnace control circuit in conjunction with respective low, medium and high call-for-heat signals to initiate low, medium and high stage operation in the furnace. Except for the fact that it controls throttling valve 60 in the manner described in connection with the FIG. 4 (i.e., to ignite the gas-air mixture at a relatively high gas flow rate and then reduce that flow rate for steady state operation at low stage), the furnace control circuit used with the embodiment of FIG. 6 operates with the three pressure switches thereof in generally the same way the furnace control circuit of the embodiment of FIG. 4 operates with the two pressure switches of that embodiment. Since the manner in which furnace control circuits operate in conjunction with pressure switches is well known to those skilled in the art, the operation of the gas flow control assembly of FIG. 6 will not be described in detail herein.

Figure 7:
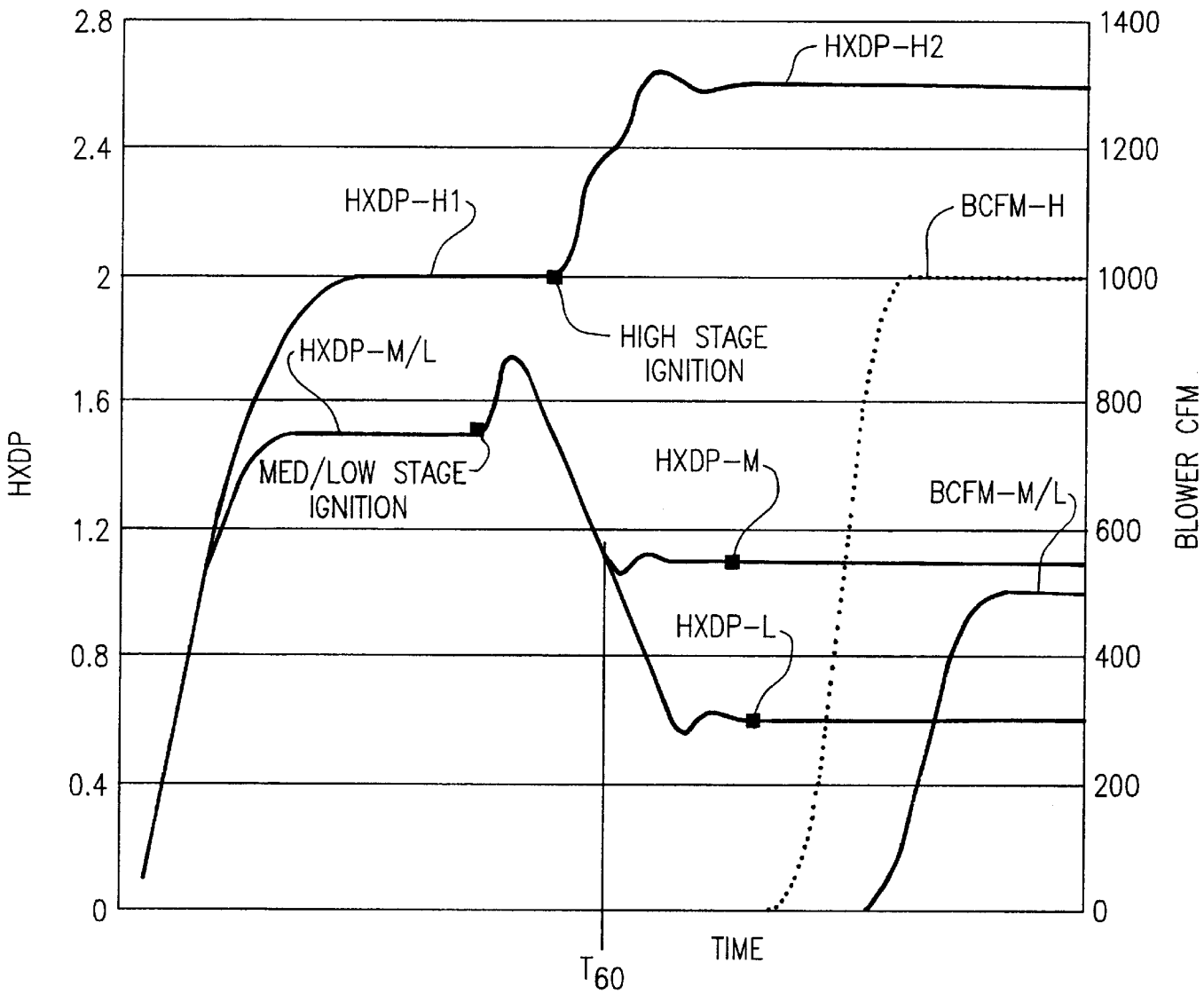
FIG. 7 is a diagram which shows how the heat exchanger differential pressure and the circulating airflow of a second embodiment of the three-stage furnace of the invention vary as functions of time during high, medium and low stage operation.

Referring to FIG. 7 there is shown an airflow diagram which illustrates the operation of the second embodiment of the furnace of the invention. This operation is generally similar to that described earlier in connection with the embodiment of FIGS. 4 and 5, except for two important differences. One of these is that, unlike the furnace of the embodiment of FIGS. 4 and 5, the furnace of the embodiment of FIGS. 6 and 7 causes its inducer blower to establish steady state combustion airflows which correspond to three different HXDP values, one for each of the three different firing rates at which the furnace is to operate. These include HXDP-L, the HXDP value that is associated with low stage operation, HEDP-M, the HXDP value that is associated with medium stage operation, and HXDP-H, the HXDP that is associated with high stage operation. The fact that the HXDP-M and HXDP-L curves coincide with one another prior to time $T_{60}$ and diverge from one another after that time reflects the earlier described switching of valve 60 from its high open state to its low open state.

A second difference is that, unlike the furnace of the embodiment of FIGS. 4 and 5, the furnace of the embodiment of FIGS. 6 and 7 causes its circulating blower motor to run at speeds that correspond to only two different circulating airflow values. These include BCFM-H, the blower airflow value that is associated with high stage operation and BCFM-M/L, the blower airflow value that is associated with medium and low stage operation. It is the use of the same circulating airflow for both medium and low stage operation that enables the second embodiment to operate at a higher AFUE than the first embodiment, and thereby eliminate the increase in annual operating cost that was discussed earlier in connection with the first embodiment. This improvement in AFUE, however, is achieved at the expense of a reduction in the rise level of the furnace, and makes necessary the use of a heat exchanger which is made of a corrosion resistant material such as stainless steel.

As will be apparent to those skilled in the art, the fact that the second embodiment of the furnace of the invention establishes the same circulating airflows during medium and low stage operation it should not be limited to this restriction. It is merely the point of operation that maintains the same circulating air noise and would give the maximum AFUE along with the lowest operating cost possible. As a result, even though the embodiment of FIGS. 6 and 7 establishes the same circulating airflows during medium and low stage operation, it is still able to operate more quietly during low stage than during medium stage, and thereby provide the reduced noise levels and improved thermal comfort contemplated by the present invention.

While the present invention has been described with reference to a number of specific embodiments, it will be understood that these embodiments are exemplary only and that the true spirit and scope of the present invention should be determined with reference to the following claims.

What is claimed is:

1. A gas-fired induced-draft furnace which has a low, a medium and a high firing rate, said furnace includes a burner, a circulating air blower for establishing a flow of circulating air, an inducer blower for establishing a flow of combustion air, and a heat exchanger, and which is adapted to operate in conjunction with temperature sensing means for sensing the temperature of a space to be heated and generating call-for-heat signals which correspond to one of said high, medium, and low firing rates; comprising:

gas flow control means for controlling the rate at which gas is supplied to said burner, said gas flow control means serving to supply gas to said burner at one of said high, medium and low firing rates;

pressure sensing means for generating differential pressure signals that vary in accordance with the pressure across said heat exchanger;

furnace control means, responsive to said differential pressure signals and to said call-for-heat signals, for:

(i) controlling the rate at which said gas flow control means supplies gas to said burner;

(ii) applying, to said circulating air blower, blower control signals which cause said circulating air blower to establish circulating airflows having magnitudes which correspond to said high and low firing rates;

(iii) applying, to said inducer blower, inducer control signals which cause said inducer blower to establish combustion airflows having magnitudes which correspond to said high, medium, and low firing rates;

wherein the magnitudes of the circulating airflows which are established by said circulating air blower during steady state operation of the furnace at said low and medium firing rates are so related to one another, and to the magnitudes of the combustion airflows which are established by said inducer blower during steady state operation of said furnace at said low and medium firing rates, that the fuel utilization efficiency of said furnace is approximately the same during steady state operation at said low and medium firing rates.

2. A furnace as set forth in claim 1 in which the fuel utilization efficiency of said furnace during steady state operation at said low firing rate is equal to or greater than the fuel utilization efficiency of said furnace during steady state operation at said medium firing rate.

3. A furnace as set forth in claim 1 which said heat exchanger includes a wall composed of a material that is resistant to cold spot corrosion, and in which some part of said wall has a temperature that is lower than the condensation temperature of water during steady state operation of said furnace at said low firing rate.

4. A furnace as set forth in claim 1 in which the combustion airflows that are established during steady state operation of the furnace at said low, medium and high firing rates result in differential pressure signals which have different respective magnitudes.

5. A furnace as set forth in claim 4 in which the circulating airflows that are established during steady state operation of said furnace at said low and medium firing rates have magnitudes which are approximately equal to one another.

6. A furnace as set forth in claim 1 in which said pressure sensing means includes three pressure switches which are connected to sense the differential pressure across said heat exchanger and to provide different respective differential pressure signals to said furnace control means.

7. A furnace as set forth in claim 1 in which said gas flow control means includes a main gas valve having first and second open states, a throttling valve having first and second open states, and means for connecting said main and throttling valves in fluidic series between a source of gas and said burner, and in which said furnace control means controls the rate at which gas flows from said source to said burner by establishing predetermined combinations of states in said main and throttling valves.

8. A furnace as set forth in claim 7 in which said furnace control means is arranged to control the combination of states in said main and throttling valves so that, for operation at said low firing rate, gas is supplied to said burner at a first, relatively high rate prior to ignition and at a second, relatively low rate after ignition.

9. A gas-fired induced-draft furnace which has a low, a medium and a high firing rate, said furnace includes a burner, a circulating air blower for establishing a flow of circulating air, an inducer blower for establishing a flow of combustion air, and a heat exchanger assembly, and which is adapted to operate in conjunction with temperature sensing means for sensing the temperature of a space to be heated and generating call-for-heat signals which correspond to one of said high, medium, and low firing rates; comprising:

a gas flow control assembly for controlling the rate at which gas is supplied to said burner, said gas flow control assembly serving to supply gas to said burner at one of said high, medium and low firing rates;

at least one pressure sensor for generating at least one differential pressure signal that varies in accordance with the pressure across said heat exchanger assembly;

a furnace control circuit responsive to said at least one differential pressure signal and to said call-for-heat signals, for:

(i) controlling the rate at which said gas flow control assembly supplies gas to said burner;

(ii) applying, to said circulating air blower, blower control signals which cause said circulating airflows having magnitudes which correspond to said high and low firing rates;

(iii) applying, to said inducer blower, inducer control signals which cause said inducer blower to establish combustion airflows having magnitudes which correspond to said high, medium, and low firing rates;

wherein the furnace control circuit applies, to said circulating air blower and said inducer blower, control signals having magnitudes which assure that the fuel utilization efficiency of said furnace is approximately the same during steady state operation at said low and medium firing rates.

10. A furnace as set forth in claim 9 in which the fuel utilization efficiency of said furnace during steady state operation at said low firing rate is equal to or greater than the fuel utilization efficiency of said furnace during steady state operation at said medium firing rate.

11. A furnace as set forth in claim 9 in which said heat exchanger assembly includes a primary heat exchanger having a wall composed of a material that is resistant to cold spot corrosion and a secondary heat exchanger, and in which some part of the wall of said primary heat exchanger has a temperature that is lower than the condensation temperature of water during steady state operation of said furnace at said low firing rate.

12. A furnace as set forth in claim 9 in which the combustion airflows that are established during steady state operation of the furnace at said low, medium and high firing rates have different respective magnitudes.

13. A furnace as set forth in claim 12 in which the magnitudes of the circulating airflows that are established during steady state operation of the furnace at said low and medium firing rates are approximately equal to one another.

14. A furnace as set forth in claim 9 in which said at least one pressure sensor includes three pressure switches which are connected to sense the differential pressure across said heat exchanger assembly and to provide different respective differential pressure signals to said furnace control circuit.

15. A furnace as set forth in claim 9 in which said gas flow control assembly includes a main gas valve having first and second open states, a throttling valve having first and second open states, and means for connecting said main and throttling valves in fluidic series between a source of gas and said burner, and in which said furnace control circuit controls the rate at which gas flows from said source to said burner by establishing predetermined combinations of states in said main and throttling valves.

16. A furnace as set forth in claim 15 in which said furnace control circuit is arranged to control the combination of states in said main and throttling valves so that, for operation at said low firing rate, gas is supplied to said burner at a first, relatively high rate prior to ignition and at a second, relatively low rate after ignition.

17. A gas-fired induced-draft furnace which has a low, a medium and a high firing rate, said furnace includes a burner, a circulating air blower for establishing a flow of circulating air, an inducer blower for establishing a flow of combustion air, and a heat exchanger assembly, and which is adapted to operate in conjunction with temperature sensing means for sensing the temperature of a space to be heated and generating call-for heat signals which correspond to one of said high, medium, and low firing rates; comprising:

a gas flow control assembly for controlling the rate at which gas is supplied to said burner, said gas flow control assembly serving to supply gas to said burner at one of said high, medium and low firing rates;

pressure responsive means for causing said gas flow control assembly to supply gas to said burner at one of said high, medium and low firing rates, depending on the differential pressure across said heat exchanger assembly;

a furnace control circuit, responsive to said call-for-heat signals, for:

(i) applying, to said circulating air blower, blower control signals which cause said circulating airflows having magnitudes which correspond to said high, medium, and low firing rates; and (ii) applying, to said inducer blower, inducer control signals which cause said inducer blower to establish combustion airflows having magnitudes which correspond to said high, medium and low firing rates;

wherein the circulating airflows that correspond to said low and medium firing rates are at least approximately equal to one another; and wherein the furnace control circuit applies, to said circulating air blower and said inducer blower, control signals having magnitudes which assure that the fuel utilization efficiency of said furnace is approximately the same during steady state operation at said low and medium firing rates.

18. A furnace as set forth in claim 17 in which the circulating airflows that correspond to said low and medium firing rates are equal to one another.

* * * * *